US006318772B1

(12) United States Patent
Pearson

(10) Patent No.: US 6,318,772 B1
(45) **Date of Patent: *Nov. 20, 2001**

(54) STRIKER AND BASE AND INSERT THEREFOR

(75) Inventor: Terrence Anthony George Pearson, Alcester (GB)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,463

(22) Filed: Jul. 17, 2000

Related U.S. Application Data

(63) Continuation of application No. 08/838,551, filed on Apr. 9, 1997, now Pat. No. 6,089,627.

(30) Foreign Application Priority Data

Apr. 10, 1996 (FR) ..... 96 04455

(51) Int. Cl.[7] ..... E05B 15/02
(52) U.S. Cl. ..... 292/341.18; 292/340
(58) Field of Search ..... 292/340, 341.12, 292/341.13, 341.14, 341.18, DIG. 38, DIG. 53

(56) References Cited

U.S. PATENT DOCUMENTS

| | | | | |
|---|---|---|---|---|
| 1,769,280 | * | 7/1930 | Welshofer | 292/340 |
| 2,094,119 | * | 9/1937 | Flora | 292/340 |
| 2,255,860 | * | 9/1941 | Riedel | 292/340 |
| 3,241,873 | * | 3/1966 | Russell | 292/340 |
| 3,287,055 | * | 11/1966 | Schlage | 292/341.12 |
| 4,453,752 | * | 6/1984 | McKann | 292/341.19 |
| 5,118,151 | * | 6/1992 | Nicholas | 292/341.19 |
| 5,456,507 | * | 10/1995 | Jones | 292/340 |

FOREIGN PATENT DOCUMENTS

2445834 * 8/1974 (DE) .

* cited by examiner

*Primary Examiner*—Gary Estremsky
(74) *Attorney, Agent, or Firm*—Stroock & Stroock & Lavan LLP

(57) ABSTRACT

A striker for a fixed frame includes an opening adapted to accommodate a latch member of an opening leaf fitting. The striker includes a base that can be fixed to the fixed frame and an insert including an opening which can accommodate the latch member. The base includes an opening forming a housing for the insert.

12 Claims, 3 Drawing Sheets

STRIKER AND BASE AND INSERT THEREFOR

CROSS REFERENCE TO RELATED APPLICATIONS

This application is a continuation of application Ser. No. 08/838,551 filed Apr. 9, 1997, currently U.S. Pat. No. 6,089,627.

BACKGROUND OF THE INVENTION

1. Field of the invention

The present invention concerns a striker for a fixed frame of a window, door, French window or the like.

2. Description of the prior art

Strikers fitted to fixed frames have always had a front face adapted to be disposed in the front edge of the frame with an opening adapted to accommodate a latch member of an opening leaf fitting.

The fittings can be of the lock, espagnolette bolt, espagnolette bolt/lock, espagnolette bolt/latch, espagnolette bolt/stud or like type. The latch members are therefore of different types depending on the type of fitting (latch bolt, lock bolt, roller, end of rod, etc) and therefore require as many different types of striker as there are different types of latch member.

Moreover, the median axis of the latch member, i.e. the axis passing through the middle of the latch member and parallel to the vertical median plane passing through the middle of the rebate of the upright or of the crosspiece on which the fitting is mounted, can be at a varying distance from the outside face of the upright or of the crosspiece of the opening leaf on which the latch member is mounted.

Consequently, it is necessary to provide different types of striker with different outside dimensions in order for the opening of the striker to be aligned exactly with the latch member.

Finally, there are different types of striker according to how the striker is fixed to the fixed frame (surface mounted, studded or fixed into a recess or a groove in the fixed frame).

It is therefore understandable that the variations of these three parameters: the shape of the latch member, the distance between the median axis of the member and the plane of the outside face of the opening leaf, and the method of fixing the striker to the fixed frame, increase the number of different strikers that must be manufactured and stocked in order to meet all possible needs.

The main aim of the present invention is to propose a new striker structure that considerably reduces the number of different strikers to be made and stocked.

SUMMARY OF THE INVENTION

The invention consists in a striker for a fixed frame of a window, door, French window or the like including an opening adapted to accommodate a latch member of an opening leaf fitting, the striker including a base adapted to be fixed to said fixed frame and an insert including an opening adapted to accommodate said latch member, said base including an opening forming a housing for said insert.

This striker in two parts limits the number of different parts to be provided: the base fixed to the fixed frame matches the method of fixing to the fixed frame and the insert has an opening the shape of which matches the latch member and the position of the median vertical axis of this member.

For a given method of fixing the striker to the fixed frame, the base of the striker is the same and only the insert is changed to suit the shape and the position of the latch member.

Conversely, for a predefined latch member, only the base is modified, to suit the method of fixing to the fixed frame, the insert always being the same.

The number of different parts to be made is therefore considerably reduced because of the combinations of one base and one insert constituting the various types of striker.

What is more, the striker being fixed by means of the base, only the latter needs to be made from a material that is sufficiently strong to achieve firm fixing of the striker to the fixed frame.

The insert can be fabricated in a less costly material.

In one advantageous version of the invention, the insert has walls between which the opening lies, an outside face of the walls mates with edges of the opening in the base and includes at least one fixing lug, and the walls and the fixing lug(s) are adapted to pass between the edges of the opening in the base, the fixing lug(s) springing back to a position in line with a peripheral area of the opening after passing beyond the edges of the opening.

Thus the insert is simply clipped into the opening in the base and does not require any fixing means other than the lugs on the walls of the insert.

In a preferred version of the invention, the opening in the insert lies between two lateral walls adapted to be parallel to an outside face of an upright or of a crosspiece of the fixed frame to which the striker is fitted, the walls having different thicknesses in an area adjacent the edges of the opening in the base.

The median axis of the opening in the insert, parallel to the plane of the lateral walls, is therefore offset from the median axis of the opening in the base.

Accordingly, by changing the thickness of one or the other of the lateral walls of the insert, the position of the median axis of the opening can be varied so that the opening is exactly aligned with the latch members of the fitting mounted on the opening leaf.

In accordance with another aspect of the invention, a base comprises a series of inserts adapted to be lodged in the opening of the base, each insert having an opening adapted to accommodate a latch member selected from a latch bolt, a lock bolt, a roller, an espagnolette bolt rod end or the like.

.

When the base has been chosen to suit the method of fixing the striker to the fixed frame, it is sufficient to fix into the opening in the base the appropriate insert to accommodate the latch member.

In accordance with an equivalent aspect of the invention, a striker comprises a series of bases having an opening adapted to accommodate the insert, each base having an external contour adapted to be fixed in a groove, a slot or the like in a front edge of a fixed frame.

Other features and advantages of the invention will emerge further from the following description.

BRIEF DESCRIPTION OF THE DRAWINGS

In the accompanying drawings, given by way of non-limiting example.

DETAILED DESCRIPTION OF THE PREFERRED EMBODIMENTS

Figure 4:
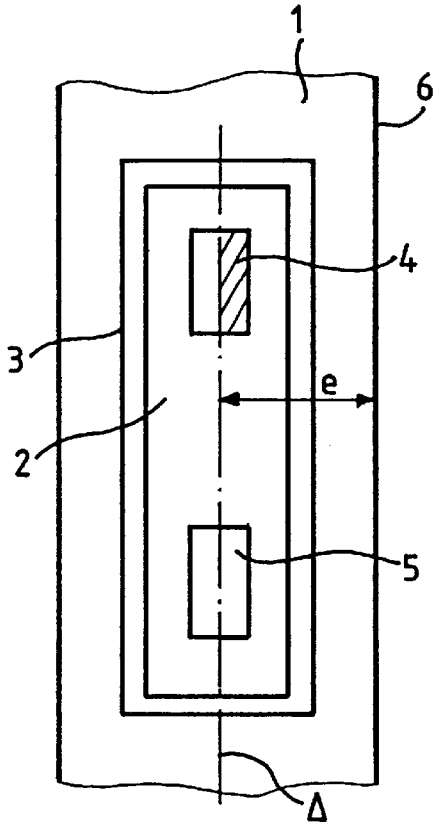
FIG. 4 is a fragmentary front view showing a latch fitting mounted on the front edge of an opening leaf.

Referring firstly to FIG. 4, the latch fittings with which the opening leaves of doors, windows, French windows or the like are equipped may incorporate a wide variety of different latch members: latch bolt, lock bolt, roller, end of espagnolette bolt rod, etc.

In the FIG. 4 example the front edge 1 of an opening leaf includes a fitting casing 2 accommodated in a groove 3 in the opening leaf and which in this example includes a latch bolt 4 and a lock bolt 5.

Over and above the diversity of latch members, the distance e of the median axis Δ from the outside face 6 of the upright or of the cross-piece of the opening leaf varies, and so the position of the opening in each striker must be adjusted to align it with the latch member it must accommodate.

Figure 1:
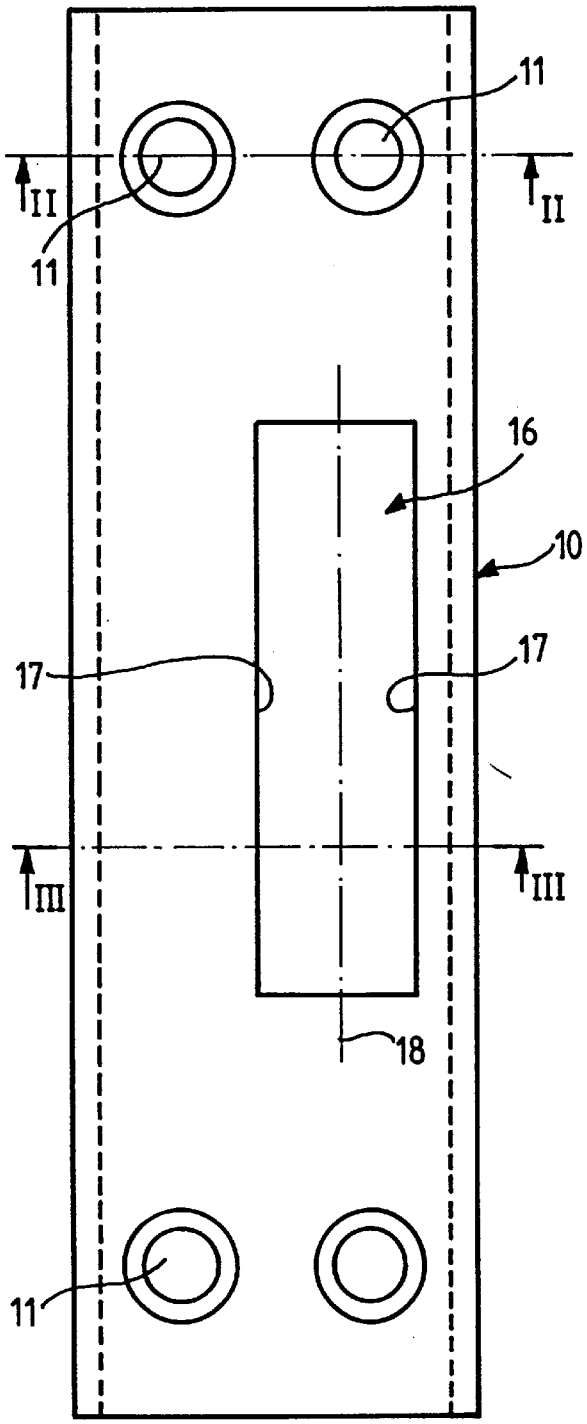
FIG. 1 a front view of a striker base of the invention.

In accordance with the invention, and referring firstly to FIG. 1, the striker has a base 10 adapted to be fixed to the fixed frame. To this end the base 10 of this example has four holes for fixing screws (not shown).

Figure 2:
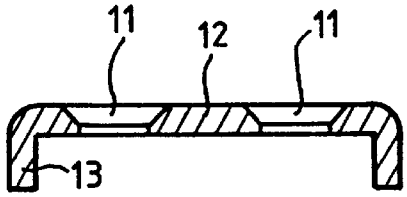
FIG. 2 is a sectional view taken along the line II—II in FIG. 1.

As shown in section in FIG. 2, the base has a substantially U-shape cross-section, the base 12 of the "U" lying parallel to the front edge of the fixed frame on which the striker is mounted.

Figure 8:
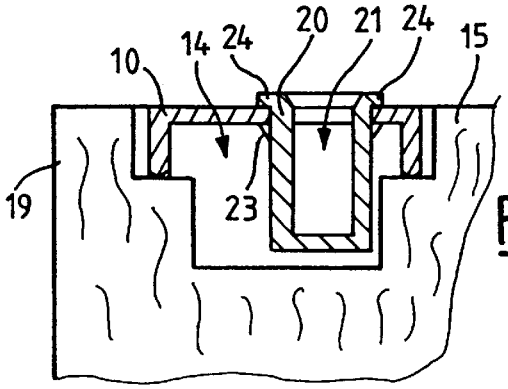
FIG. 8 is a schematic sectional view showing a striker of invention mounted on a fixed frame.
Figure 9:
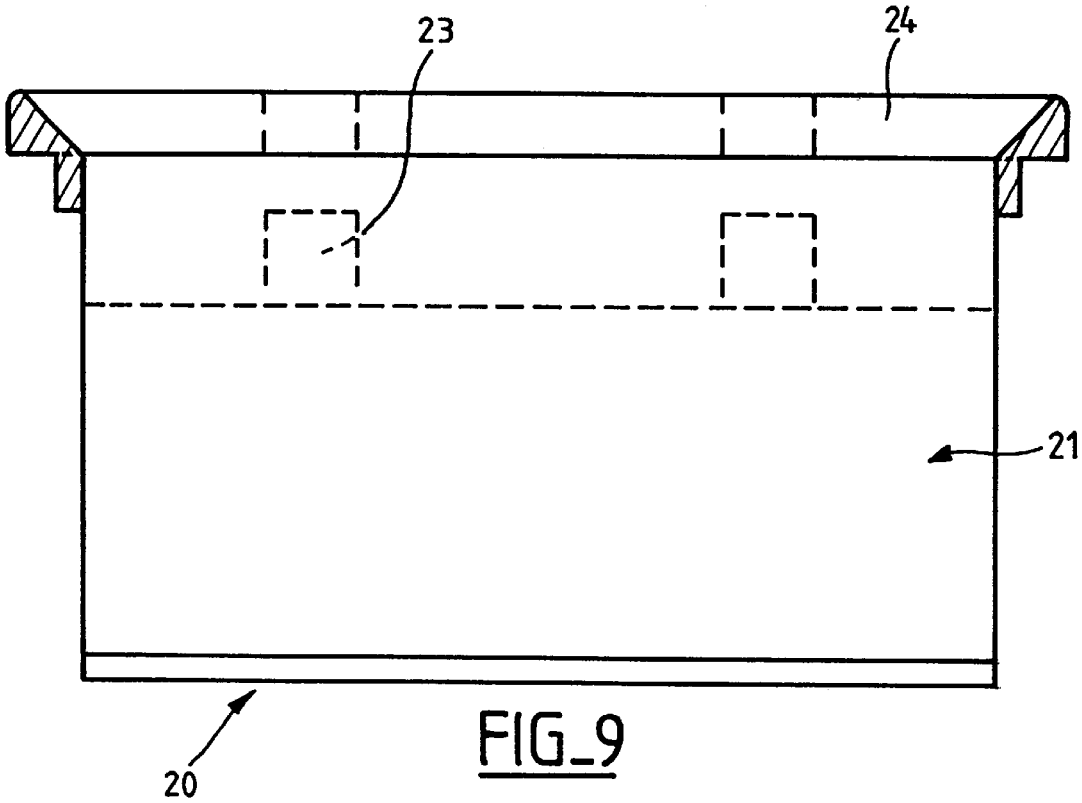
FIG. 9 is a sectional view taken along the line IX—IX in FIG. 5.
Figure 10:
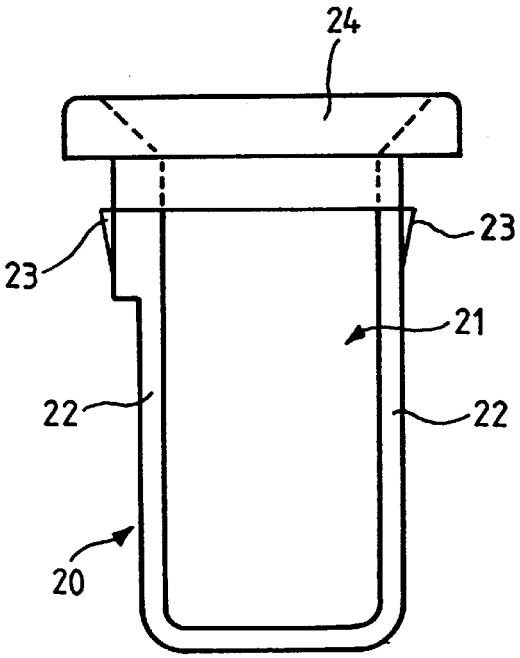
FIG. 10 is a side view of the insert from FIG. 5.

Referring to FIG. 8, it can be seen that the legs 13 of the base are designed to be accommodated in a groove 14 on the fixed frame 15.

Figure 3:
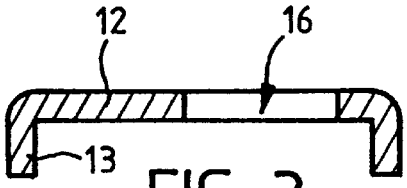
FIG. 3 is a sectional view taken along the line III—III in FIG. 1.

The base 10 also has an opening 16, shown in section in FIG. 3.

Figure 5:
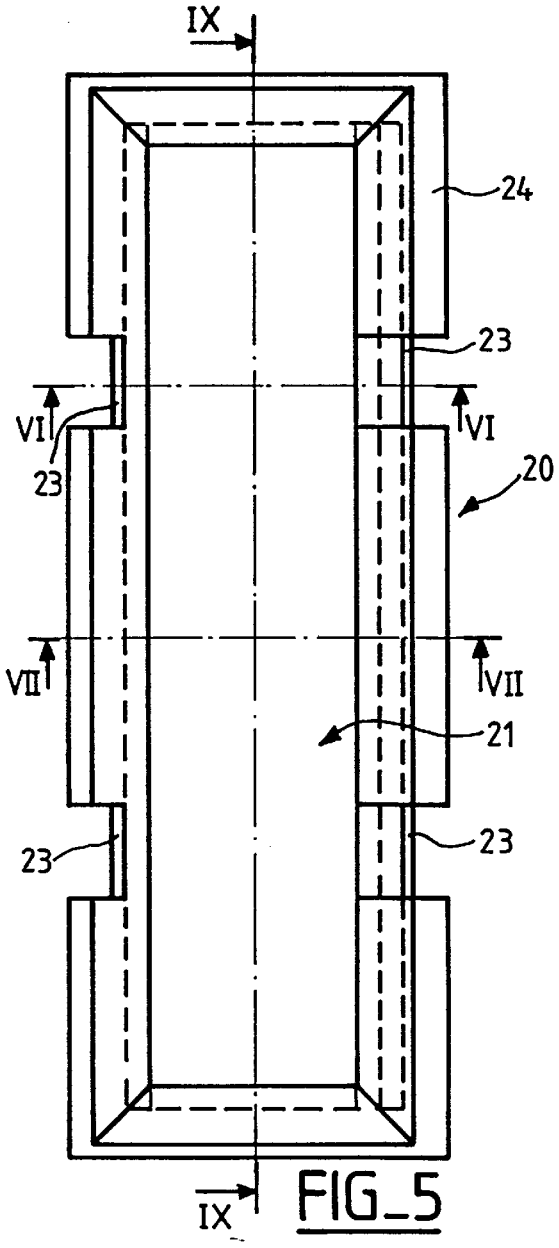
FIG. 5 is a front view of a striker insert of the invention.

This opening 16 forms a housing for an insert 20 shown in FIG. 5.

The insert 20 includes an opening 21 adapted to accommodate a latch member.

In this example, the opening 21 is adapted to receive the end of a rod. However, it is obvious that the shape of the opening 21 could be modified to accommodate a latch roller, a latch bolt or a lock bolt.

The opening 21 could also be adapted for righthand or lefthand use, depending on the direction in which the opening leaf opens.

In the case of windows with more than one leaf, the insert 20 may have the same number of openings 21 as the number of leaves. Accordingly, for a window with two leaves, it is possible to lock simultaneously a semi-fixed leaf and a mobile leaf.

As shown in the various views of FIGS. 6, 7, 9 and 10, the insert 20 has walls 22 between which the opening 21 lies, the outside face of the walls 22 mating with the edges 17 of the opening 16 in the base 10 and incorporating at least one fixing lug 23.

The walls 22 and the fixing lugs 23 are adapted to pass between the edges 17 of the opening 16 in the base 10, the fixing lugs 23 springing back to a position in line with a peripheral area of the opening 16 after passing beyond the edges 17 of the opening 16.

As shown in section in FIG. 8, when the insert 20 is in place in the opening 16 in the base 10, the lugs 23, of which there are four in this example, are in line with the peripheral area around the opening 16 in the base 10 and are engaged with the edges of the inside face 10*a* of the base 10.

Moreover, the walls 22 of the insert 20 incorporate a flange 24 substantially surrounding the opening 21 in the insert 20 and adapted to cover the base 10 in the peripheral area of the opening 16, this peripheral area being gripped between the flange 24 and the fixing lugs 23.

In addition to fixing the insert 20 into the base 10, this flange 24 covers the edges 17 of the opening 16 and provides a seal between these edges 17 and the walls 22 of the insert 20.

The flange 24 is preferably interrupted in line with the fixing lug(s) 23. This makes it easier for the walls 22 of the insert 20 to move towards each other upon inserting the insert into the opening 16 in the base 10 and thereby facilitates the movement of the fixing lugs 23 beyond the edges 17 of the opening 16.

The opening 21 of the insert 20 lies between two lateral walls 22 that are adapted to be parallel to the outside face 19 of the upright (or the crosspiece) of the fixed frame 15 to which the striker is fitted.

These walls 22 have different thicknesses in an area 25 adjacent the edges 17 of the opening 16 of the base 10.

The median axis 26 of the opening 21 in the insert is therefore offset relative to the median axis 27 of the insert 20 itself, which is halfway between the outside faces of the lateral walls 22 in the area 25 adjacent the edges 17 of the opening 16.

The median axis 27 of the insert 20 is always coincident with the median axis 18 of the opening 16 in the base 10, whereas the median axis 26 of the opening 21 in the insert 20 can be offset to either side of the median axis 18 of the opening 16.

Figure 6:
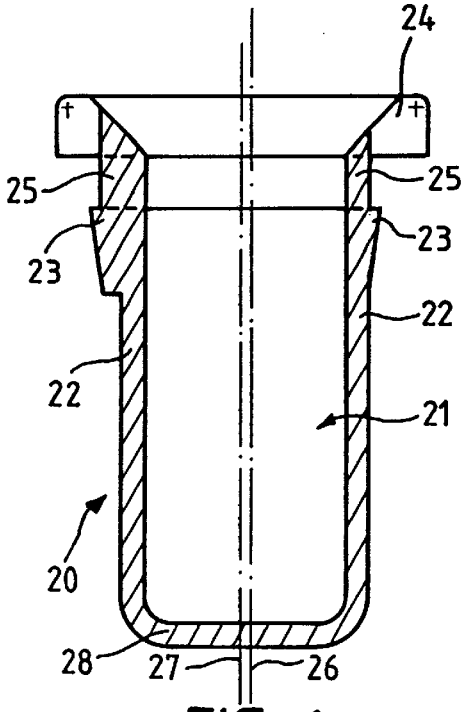
FIG. 6 is a sectional view taken along the line VI—VI in FIG. 5.
Figure 7:
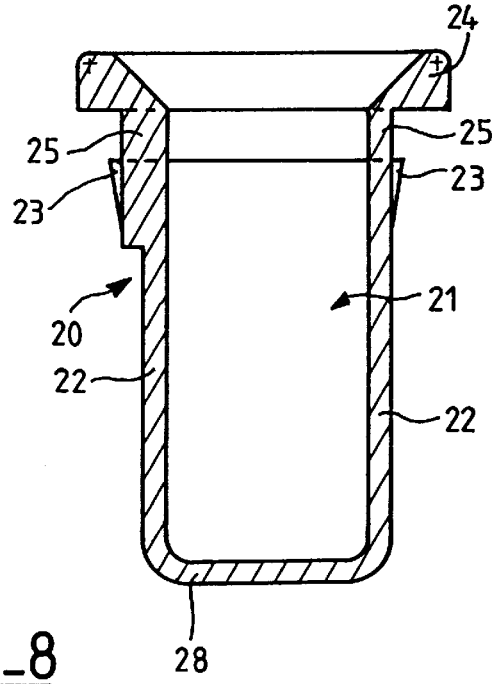
FIG. 7 is a sectional view taken along the line VII—VII in FIG. 5.
Figure 11:
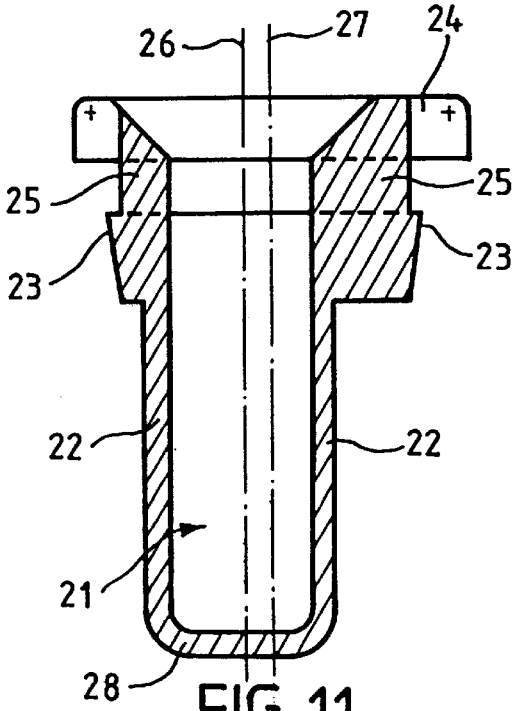
FIG. 11 is a sectional view similar to FIG. 6 of a second embodiment of insert.

Accordingly, in FIG. 6, the median axis 26 is offset to the right (as seen in the figure) relative to the median axis 27, whereas in a different embodiment shown in FIG. 11 the median axis 26 of the opening 21 is offset towards the left (as seen in the figure).

Merely by modifying the thickness of the area 25 of the lateral walls 22, different inserts are obtained, from which the one enabling the median axis 26 of the opening 21 to be aligned with the median axis Δ of the latch member 4, 5 is chosen.

The lateral walls 22 are preferably linked at the back of the opening 21 by a back wall 28 so that the cross-section of the insert 20 is substantially the shape of the letter "U".

To save material, only the area 25 of the wall 22 is more or less thick to modify the position of the median axis 26 of the opening 21, the remainder of the lateral walls 22 and the back wall 28 being thinner.

Each base 10 can therefore include, as accessories, a series of inserts 20 adapted to be lodged in the opening 16 of the base 10, each insert 20 having an opening 21 adapted to accommodate a latch member 4, 5 selected from a lock bolt, a latch bolt, a roller, an espagnolette bolt rod end or the like.

Moreover, each insert 20 has lateral walls 22 normally having different thicknesses in an area 25 adapted to lie adjacent the edges 17 of the opening 16 in the base 10. Of course, the set of inserts that can be used with a particular base includes an insert whose walls 22 have respective equal thicknesses in the area 25.

Conversely, each insert 20 can comprise, as accessories, a series of bases 10 having an opening 16 adapted to accommodate the insert 20, each base 10 having an outside contour adapted to be fixed to a groove 14, a slot or the like in the front edge of the fixed frame 15.

The invention reduces the proliferation of different types of striker.

Of course, the invention is not limited to the embodiment described hereinabove and many modifications may be made to the latter without departing from the scope of the invention.

Thus the striker of the invention may be fitted either to an upright or a crosspiece of a fixed frame.

The same base could include a plurality of openings 16 each adapted to accommodate a particular insert 10.

What is claimed is:

1. A striker device for a fixed frame associated with a leaf carrying a latch member having a median axis and being adapted to be accommodated in said striker device, said striker device comprising:

a base constructed to be received in a predetermined position in a predetermined hole of said frame, said base having a plate-like web through which is arranged a first opening extending between substantially parallel main edges thereof, said first-opening having a first median axis between said main edges, said first median axis being adapted to have a predetermined fixed position on said fixed frame; and an insert constructed to be matingly engaged at a predetermined place in said first opening between said main edges so that a median axis of said insert is coincident with said first median axis of said first opening and is adapted to have a predetermined fixed position on said fixed frame, said insert having a second opening adapted to accommodate said latch member and extending between a first lateral wall and a second lateral wall substantially parallel to each other, said first and second lateral walls being adapted to be introduced in said first opening between said main edges and a flange extending from said first and second walls and adapted to cover said plate-like web substantially along said main edges of said first opening, a portion of an outside face of said first and second walls, close to said flange, being adjacent to and mating with a respective main edge of said first opening, said first and second lateral walls including lug means adapted to be introduced through said first opening and to matingly engage said main edges of said first opening in order to grip said main edges between said flange and said lug means, said second opening having a second median axis between said lateral walls, wherein a predetermined fixed thickness of said first lateral wall is equal to or different from a predetermined fixed thickness of said second lateral wall at least at said portions of said first and second lateral walls adjacent said main edges by a predetermined thickness difference so that said second median axis is offset by a predetermined offset distance from said first median axis in a direction substantially perpendicular to said first and second lateral walls, said predetermined offset distance being such that said second median axis is adapted to be directly aligned with said median axis of said latch member when said latch member is accommodated in said second opening in said insert to contact said base.

2. The striker device system according to claim 1, wherein said flange extends away from said second opening in said insert to contact said base.

3. The striker device system according to claim 2, wherein said frame has an outside face, said first and second lateral walls each have an inside face adapted to be positioned substantially parallel to an outside face of said fixed frame in which said base is received.

4. The striker device according to claim 3, said lug means comprising at least one fixing lug disposed on the outside face of one of said first and second lateral walls, said first and second lateral walls, said at one fixing lug passing between said edges of said first opening, and at least a portion of said main edges being retained between said flange and said at least one fixing lug.

5. The striker device system according to claim 3, wherein each said insert includes a back wall and wherein said first and second lateral walls are connected to said back wall.

6. A striker device system for a fixed frame associated with a leaf carrying a latch member adapted to be accommodated in said striker device system, said striker devise system comprising:

a base constructed to be received in a predetermined hole of said frame, said base having a plate-like web through which is arranged a first opening extending between substantially parallel main edges thereof, said first opening having a first median axis between said main edges; and a plurality of inserts, each of said plurality of inserts being constructed to be matingly engaged at a predetermined place in said first opening between said main edges, each of said plurality of inserts having a second opening adapted to accommodate said latch member and extending between a first lateral wall and a second lateral wall substantially parallel to each other of said plurality of inserts, said first and second lateral walls being adapted to be introduced in said first opening between said main edges and a flange extending from said first and second lateral walls adapted to cover said base web substantially along said main edges of said first opening, a portion of an outside face of said first and second lateral walls close to said flange being adjacent to and mating with a respective main edge of said first opening, said first and second lateral walls including lug means adapted to be introduced through said first opening and to matingly engage said main edges of said first opening to grip said edges between said flange and said lug means, said second opening having a second median axis between said lateral walls, the thickness of said first lateral wall being equal to or different from the thickness of said second lateral wall at least at said portions of said first and second lateral walls adjacent said main edges by a predetermined thickness difference so that said second median axis is offset by a predetermined offset distance from said first median axis in a direction substantially perpendicular to said first and second lateral walls, wherein each one of said plurality of inserts has its second median axis offset from said first median axis by a predetermined offset distance which is different from a predetermined offset distance corresponding to any one of the other ones of said plurality of inserts.

7. A striker device system according to claim 6, further comprising a series of bases each having a same first opening adapted to receive any one of said plurality of insert;, each particular base of said series of bases having a particular outside contour adapted to be fixed in a respective particular hole of a front edge of a fixed frame.

8. A striker device system according to claim 6, said striker system being adapted to accommodate different latch members, wherein said striker device system comprises, for each particular one of said different latch members, a particular plurality of inserts adapted to accommodate said particular one latch member.

9. The striker device according to claim 6, wherein said flange extends away from said second opening in said insert to contact said base.

10. The striker device according to claim 9, wherein said frame has an outside face, said first and second lateral walls each have an inside face positioned substantially parallel to an outside face of said fixed frame in which said base is received.

11. The striker device system according to claim 10, said lug means comprising at least one fixing lug disposed on the outside face of one of said first and second first and second lateral walls, said first and second lateral walls and said at least one fixing lug passing between said edges of said first opening, and at least a portion of said main edges being retained between said flange and said at least one fixing lug.

12. The striker device system according to claim 10, wherein each said insert of said plurality of inserts includes a back wall and wherein said first and second lateral walls are connected to said back wall.

* * * * *